US008777691B2

(12) United States Patent
Darling-Reid et al.

(10) Patent No.: US 8,777,691 B2
(45) Date of Patent: Jul. 15, 2014

(54) PLAY STRUCTURES

(75) Inventors: Maureen Darling-Reid, Essex (GB); Stephen Neil Matthews, London (GB)

(73) Assignee: Imagine & Play Limited, Essex (GB)

( * ) Notice: Subject to any disclaimer, the term of this patent is extended or adjusted under 35 U.S.C. 154(b) by 471 days.

(21) Appl. No.: 12/998,396

(22) PCT Filed: Oct. 15, 2009

(86) PCT No.: PCT/GB2009/051385

§ 371 (c)(1), (2), (4) Date: Apr. 15, 2011

(87) PCT Pub. No.: WO2010/043907

PCT Pub. Date: Apr. 22, 2010

(65) Prior Publication Data

US 2011/0195796 A1 Aug. 11, 2011

(30) Foreign Application Priority Data

Oct. 15, 2008 (GB) ..... 0818904.5

(51) Int. Cl.

| | |
|---|---|
| ***A63H 33/30*** | (2006.01) |
| ***A63H 3/52*** | (2006.01) |
| ***A63H 33/00*** | (2006.01) |

(52) U.S. Cl.

USPC ..... 446/480; 446/488

(58) Field of Classification Search

CPC ..... A63H 33/42; A63H 3/52; A63H 33/00; A63H 33/003; A63H 33/16; A63J 1/02

USPC ..... 446/480, 487, 488

See application file for complete search history.

(56) References Cited

U.S. PATENT DOCUMENTS

| | | | | | |
|---|---|---|---|---|---|
| 856,060 | A | * | 6/1907 | Hepburn | 446/480 |
| 1,531,535 | A | * | 3/1925 | Beaulien | 446/480 |
| 1,853,116 | A | * | 4/1932 | Erickson | 446/480 |
| 1,866,155 | A | * | 7/1932 | Fancher | 446/480 |
| 2,035,651 | A | * | 3/1936 | Hailparn | 40/539 |
| 2,104,628 | A | * | 1/1938 | Warren | 446/75 |
| 2,219,507 | A | * | 10/1940 | Apgar et al. | 446/480 |
| 2,262,700 | A | * | 11/1941 | Reed | 446/480 |
| 2,441,076 | A | * | 5/1948 | Makrianes | 446/75 |
| 5,632,390 | A | * | 5/1997 | Podergois | 211/195 |
| 2009/0251034 | A1 | * | 10/2009 | Nielsen et al. | 312/259 |

FOREIGN PATENT DOCUMENTS

| | | |
|---|---|---|
| DE | 396848 | 6/1924 |
| GB | 27291 | 0/1908 |
| GB | 1 375 790 | 11/1974 |
| GB | 2 321 961 A | 8/1998 |

* cited by examiner

*Primary Examiner* — Gene Kim
*Assistant Examiner* — Alyssa Hylinski
(74) *Attorney, Agent, or Firm* — Breiner & Breiner, L.L.C.

(57) ABSTRACT

An arch type play structure may be formed of a single large sheet of e.g. cardboard, which can be folded to flat form for storage, or which may be folded in such a way that parts of it form a box-like structure containing other parts of it. The arch may be decorated e.g. to represent a fireplace (5) or gate.

6 Claims, 7 Drawing Sheets

PLAY STRUCTURES

This invention relates to play structures, i.e. to temporary structures which may be used in a play scenario by children, and the invention is particularly concerned with such structures which, when not required for play, may be stowed in appropriately space-saving fashion.

It is well-known that imaginative play engaged in by young children often includes an appropriate scene in which to operate. One classic form of this is the doll's house where miniature furniture and figurines may be manipulated within the confines of a model 'house' structure. A second example is a so-called 'Wendy house' which takes the form of an appropriate enclosure which may be constructed for use outside or inside a domestic dwelling, and which constitutes a miniature 'house' in and around which the child may play.

A major problem with such structures is that they tend to be space consuming which is not always convenient.

I have now found that by the use of folded cardboard structures, a variety of play environments may be produced which have the advantage that when not required for play, they may be simply folded and stored without taking up very much space.

While when putting the present invention into practice, the preferred material of construction is corrugated cardboard, as it is inexpensive, widely available, easy to print on and recyclable. However, the invention may be practised equally well by using substitute material, for example extruded cellular sheets, such as that sold under the registered trade mark Correx. Such materials also do not need to be waterproofed if the structure is to be used outside.

According to the present invention, there is provided a structure formed of a unitary folded cardboard or like material member which is capable of being erected from a packed condition to constitute an archway closed on one side by a wall section, where the vertical members of the arch are each formed of a number of panels of card or like material hinged to the wall section and folded to form a prism with its axis vertical and wherein a horizontal lintel member of the arch is formed by a further set of panels hinged to the wall section and foldable to form a second prism with its axis horizontal.

Preferably the panels which form the lintel member of the arch have extension pieces to close the ends of the generally prismatic lintel, and preferably the lintel extends to either side of the vertical members of the arch when the arch is erected.

The arch is preferably made of a single piece of folded material, for example corrugated cardboard or the like. By the choice of appropriate grades of corrugated cardboard, it may be possible to flat pack and re-erect such an arch many times, particularly if care is used when carrying out erection or flat packing. Alternatively, the arch may be constructed of material which can fold with parts of the structure forming a box-like structure enclosing the remainder of the structure, folded to take up very little space. In particular, the wall section and vertical members may be foldable to enable their stowage within the parts which form the horizontal lintel member when the structure is erected.

While imaginative play is entirely possible with an arch construction as identified above which is devoid of decoration, it is generally preferred to decorate the material of which the archway is made in an appropriate fashion. For example, the material may be printed with images so that the arch when erected resembles a fireplace. In an alternative, it may represent a gateway with a porch. Of course, it is possible simply to produce the item plain and, for example, to sell with it appropriate colouring or painting materials so that the first time the item is erected, the child can decorate it to his or her own satisfaction and design. In a further alternative, the archway may be produced as a 'character merchandised' item.

A major advantage of the structures noted above is that they may be made of a single piece of card. In this respect, they are distinguished from the multi component toy fireplace suitable for use in a doll's house or the like or within a shop window as disclosed in published British Patent Specification 1907/27291, from hollow panel structures assembled from folded corrugated cardboard components, for example as shown in GB-A-1375790, and from multi-compartment fireplace structures disclosed in U.S. Pat. No. 1,853,116, U.S. Pat. No. 2,219,507, U.S. Pat. No. 2,262,700, and GB-A-2321961.

The term single piece of card includes both an integral card piece and a composite piece of card formed of two or more pieces of card permanently attached together. Such attachment may take the form of a flexible hinge member where the card folds, and this prolongs the service life of the structure as such flexible hinge members, e.g. made of permanently adhesive fabric or plastics tape, are able to flex many times before breaking. This is of particular value where parts of the structure fold to form a box encasing other parts of the structure, also folded, for storage, both because of the extra amount of folding needed and because to make the item from a single sheet of card would be impractical and/or inefficient as it would produce large quantities of 'offcuts' useful only for recycling.

The structure of the present invention may be assisted in maintaining its erect position by means of a variety of joining mechanisms known in the field of cardboard engineering, for example punched slots and tabs which fold to fit in them, and adhesively attached pairs of pads of bun fastener material.

The present invention is illustrated by way of example with reference to the accompanying drawings, in which.

Figure 1:
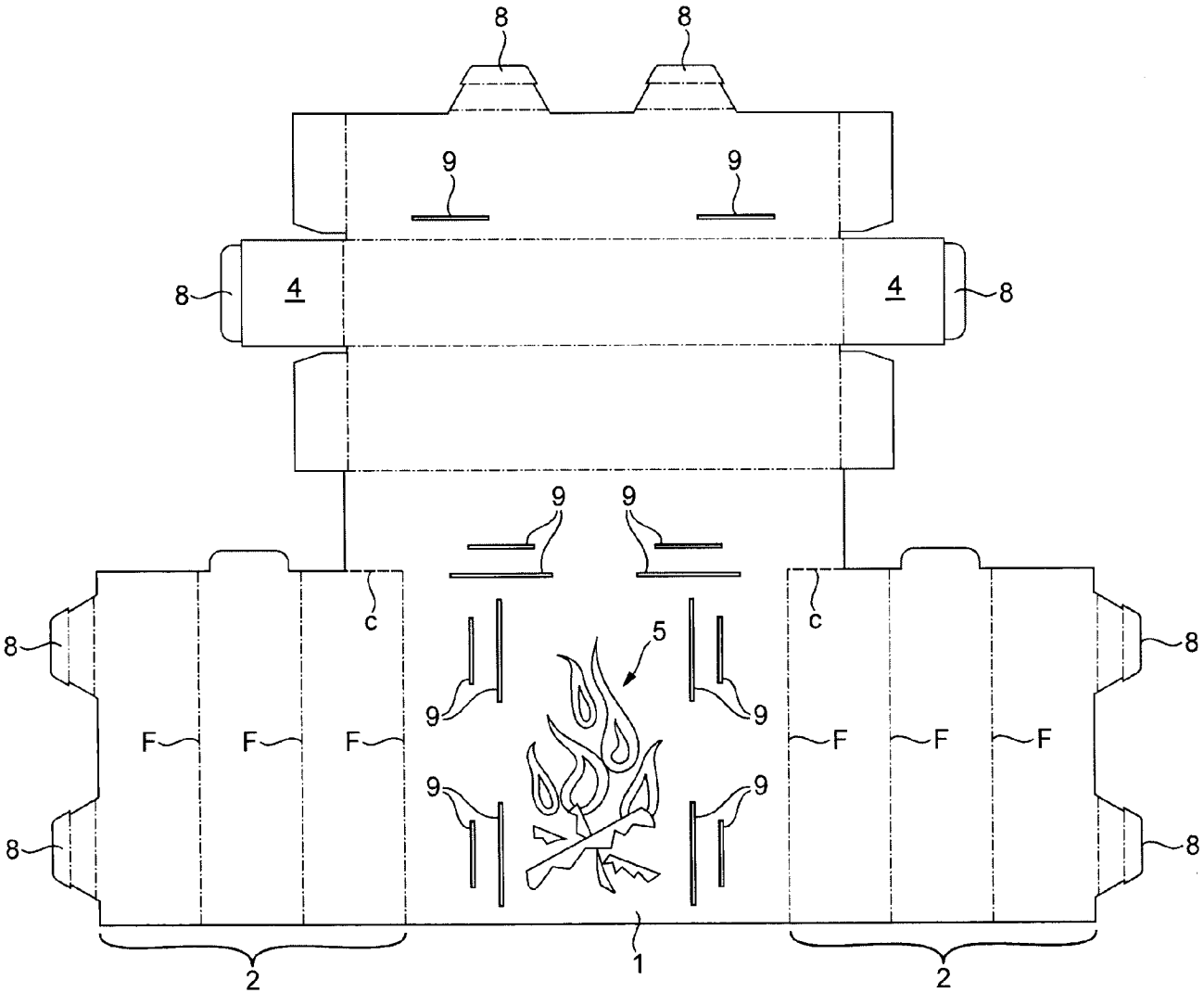
FIGS. 1 and 2 are a plans view of a card panel showing its shape and fold lines and a printed design thereon.
Figure 2:
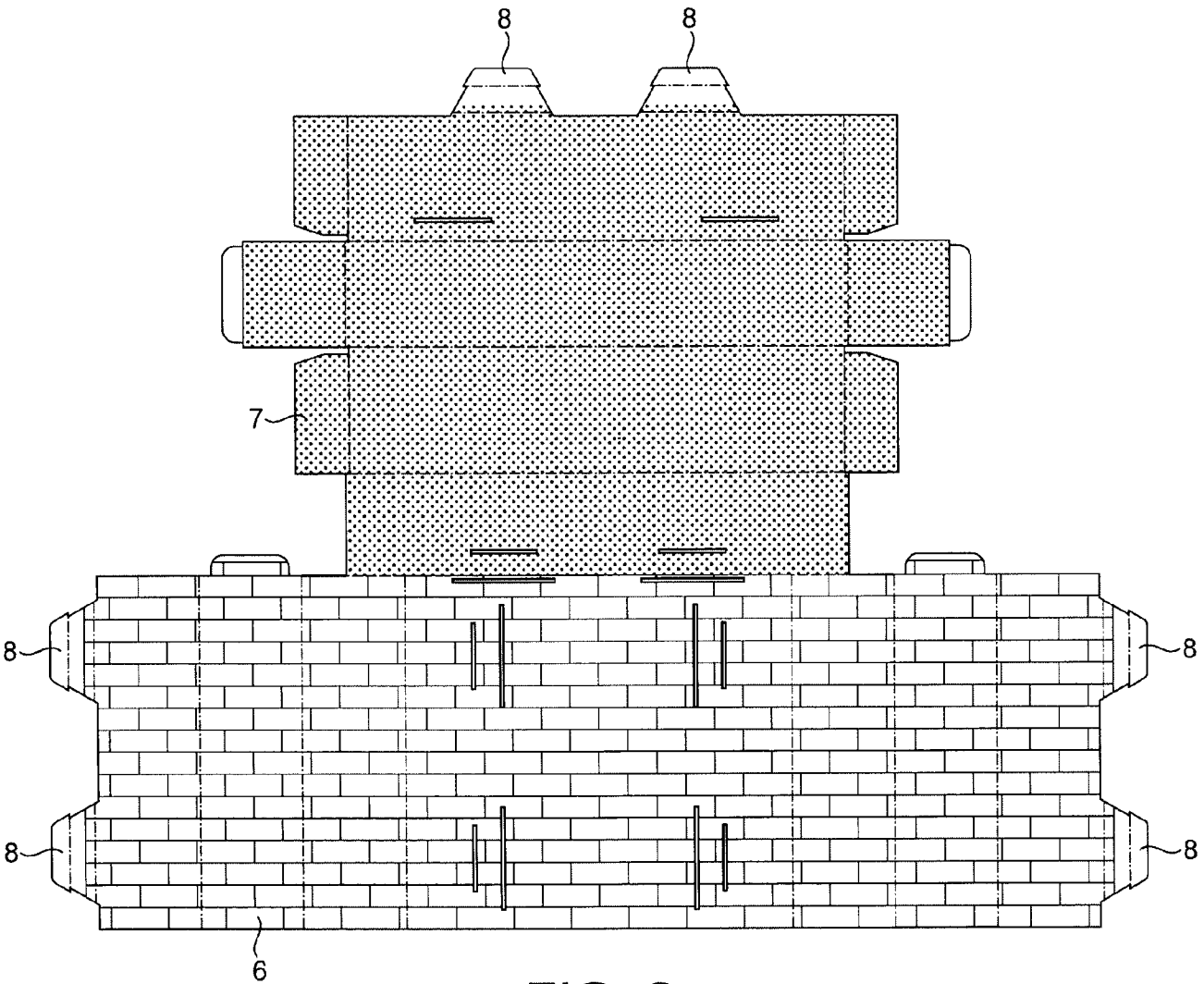

Referring first to FIGS. 1 and 2, the panel there shown is impressed with fold lines marked F and two cuts extending from the periphery marked C.

Figure 3:
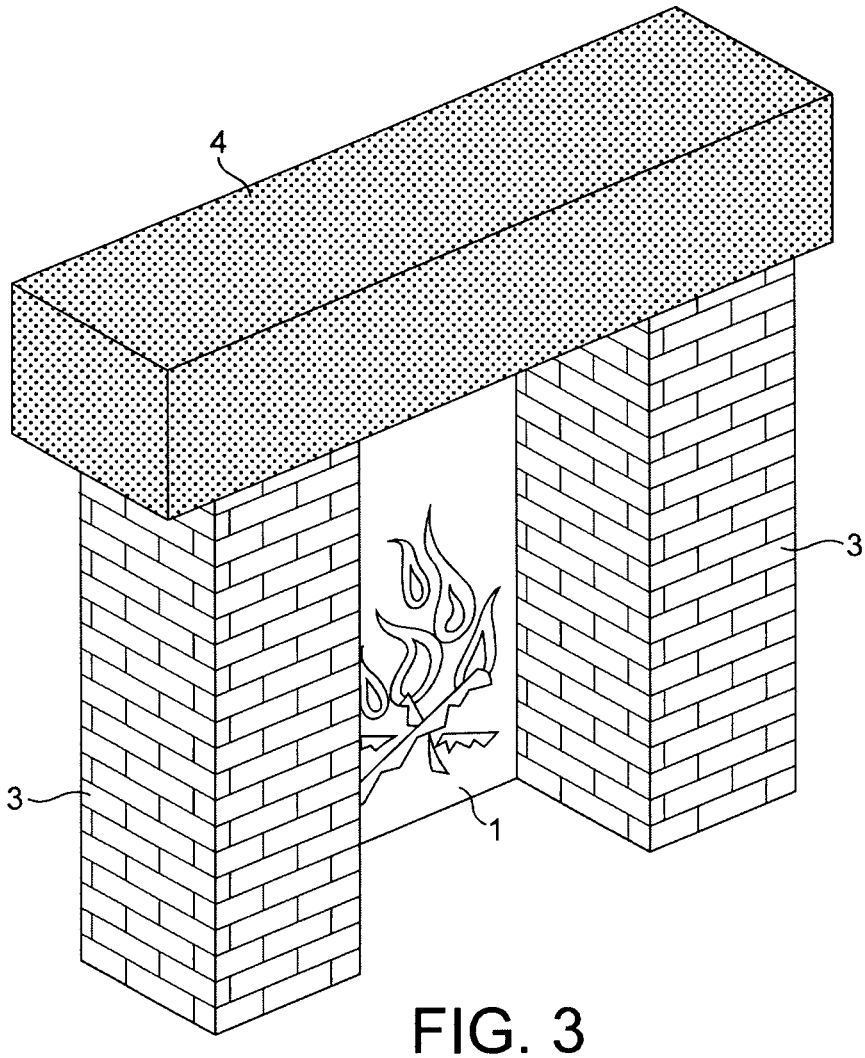
FIG. 3 is a perspective view of an archway resembling a fireplace constructed by folding the panel shown in FIGS. 1 and 2.

The rear panel of the final fireplace structure is identified by the reference number 1. It bears a representation of a fire 5. To each side of panel 1 are three panels 2 which may be folded to form a lateral pillar 3 of prismatic form, as shown in FIG. 3. If that is first done, then the remaining section of the sheet may be folded down over the ends of the prismatic sections and form the top and front of what appears to be a mantel member. The ends of the mantel may be formed by folding down the portions identified as panels 4 on FIG. 1. As can be seen, the periphery of the sheet has a number of integrally formed tabs 8 which fit into slots 9, in known fashion, to hold the structure in its erected form.

As can be seen in FIG. 2, the outside of the folded structure bears a printed representation of a brickwork structure 6 for the pillars 3 and a wooden texture 7 for the mantel.

By choosing appropriate weight cardboard, the structure thereby obtained is sufficiently strong to support modest weight items placed on the mantel. It is also stable against being knocked over too easily. However, when not required for use, it may simply be unfolded to the shape shown in FIG. 1, or, of course, if desired, to a smaller footprint by folding the mantel portion backwards and the panels forming the prismatic vertical members to lie either to the front or rear of the central panel 1.

Figure 4:
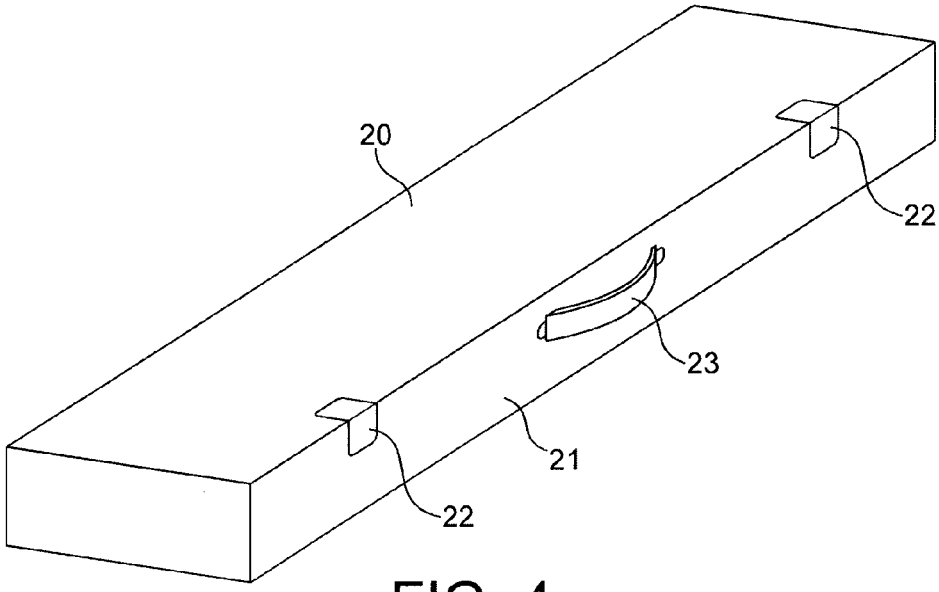
FIGS. 4 to 10 are perspective views of a second embodiment of play apparatus according to the invention and showing the deployment of the apparatus from a fully stored state in FIG. 4 to a fully erected state in FIG. 10.
Figure 10:
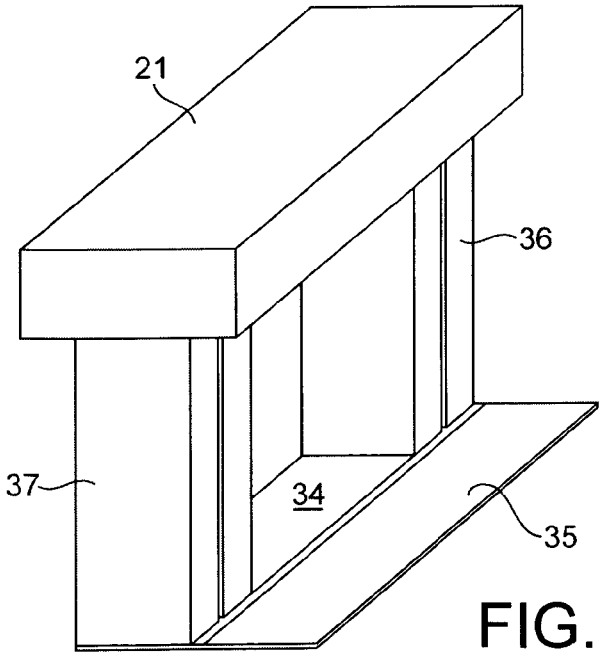

Referring now to FIGS. 4 to 10, these show successive stages of erection of an archway structure from a fully folded 'box' configuration as shown in FIG. 4 to the finished archway as shown in FIG. 10.

The item shown in these Figures is made entirely of foldable cardboard sections plus some burr fastener fixing pads and a plastics carrying handle.

As shown in FIG. 4, in stowed condition, the structure is in the form of a cardboard box having a lid 20 and base 21. The lid may be held down in place by means of a pair of bun fastener components 22 and the entire structure can be lifted by means of a plastics handle 23 which is a short flexible strip of plastics material having two headed ends which pass into pre-punched slots in the cardboard forming part of the box base 21 in known fashion.

Figure 5:
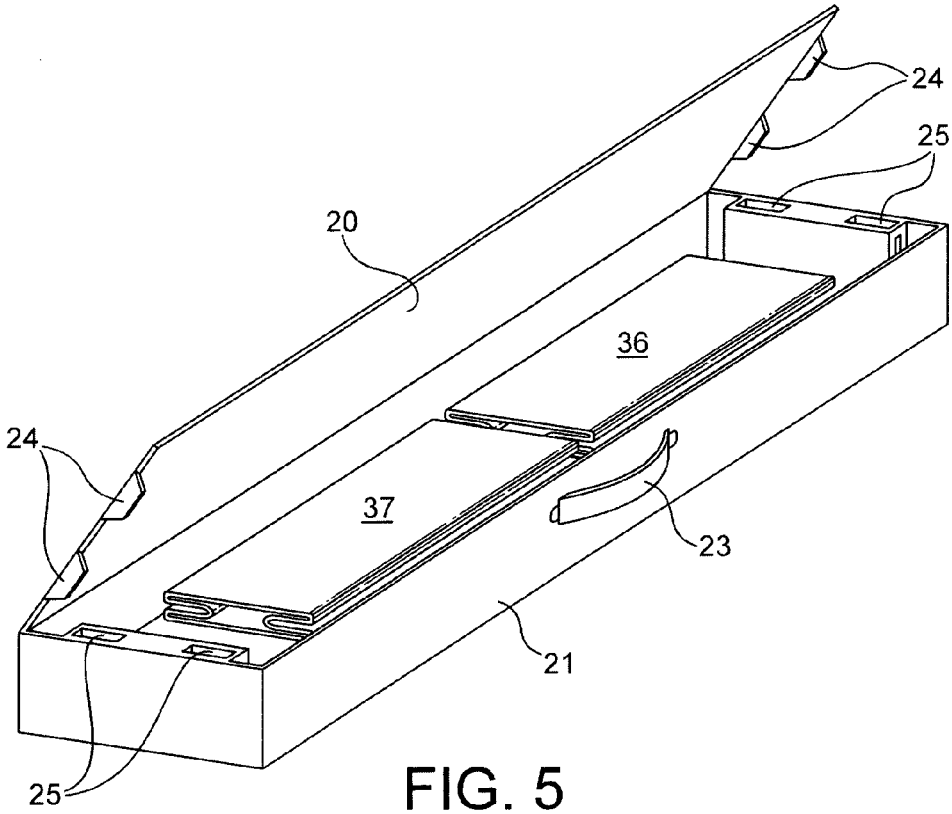

When the burr fasteners are undone, the lid 20 may be raised as shown in FIG. 5. As can be seen in that, the ends of lid 20 have tabs 24 and these are sized to engage with slots 25 near the ends of the box base 21.

Figure 6:
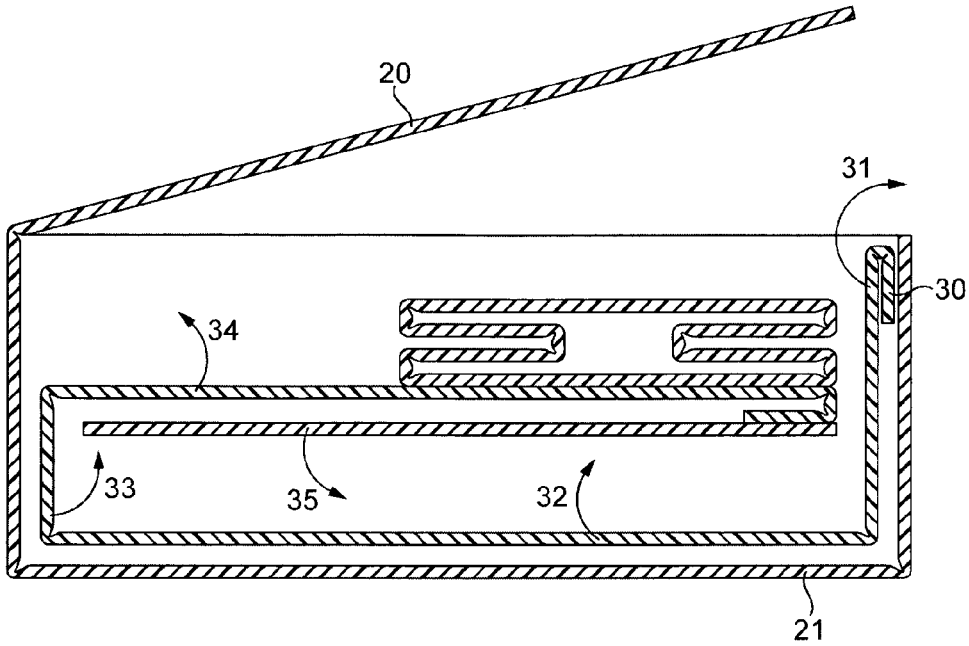

FIG. 6 is a cross-section through the structure as shown in FIG. 5. As can be seen, the lid 20 is slightly raised and within the box is a folded cardboard structure. This consists of a large panel adhered along one edge at 30 to the inside of the box base 21 and having successive parallel rectangular sections 31, 32, 33 and 34. A final extra section 35 is glued to the creased-over end of section 34.

Figure 7:
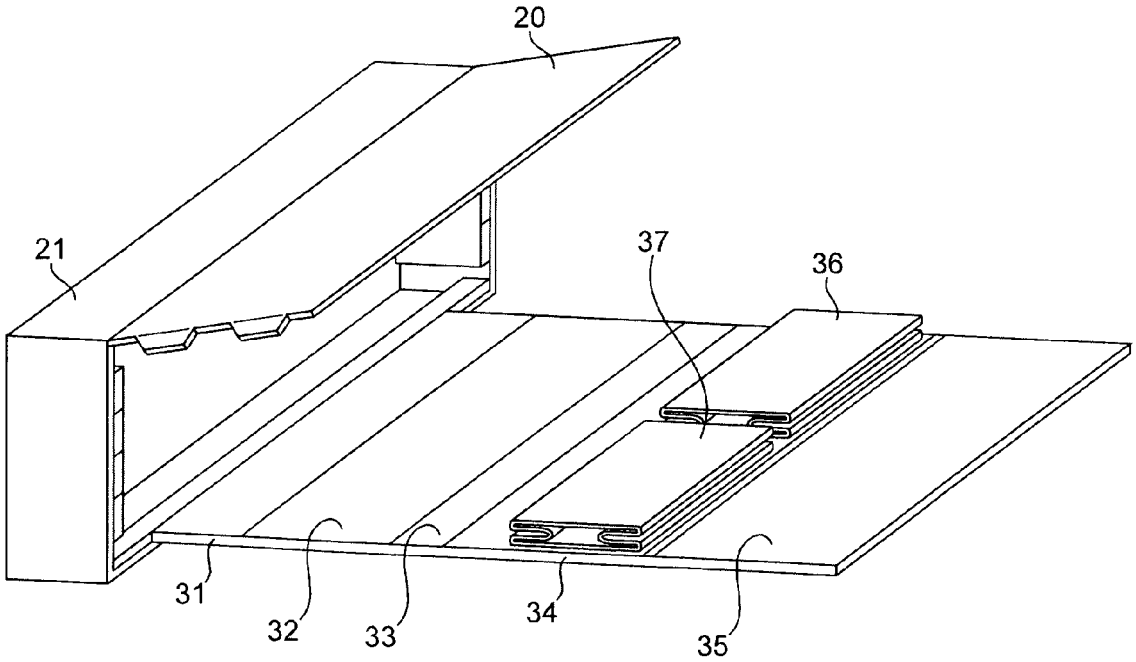
Figure 8:
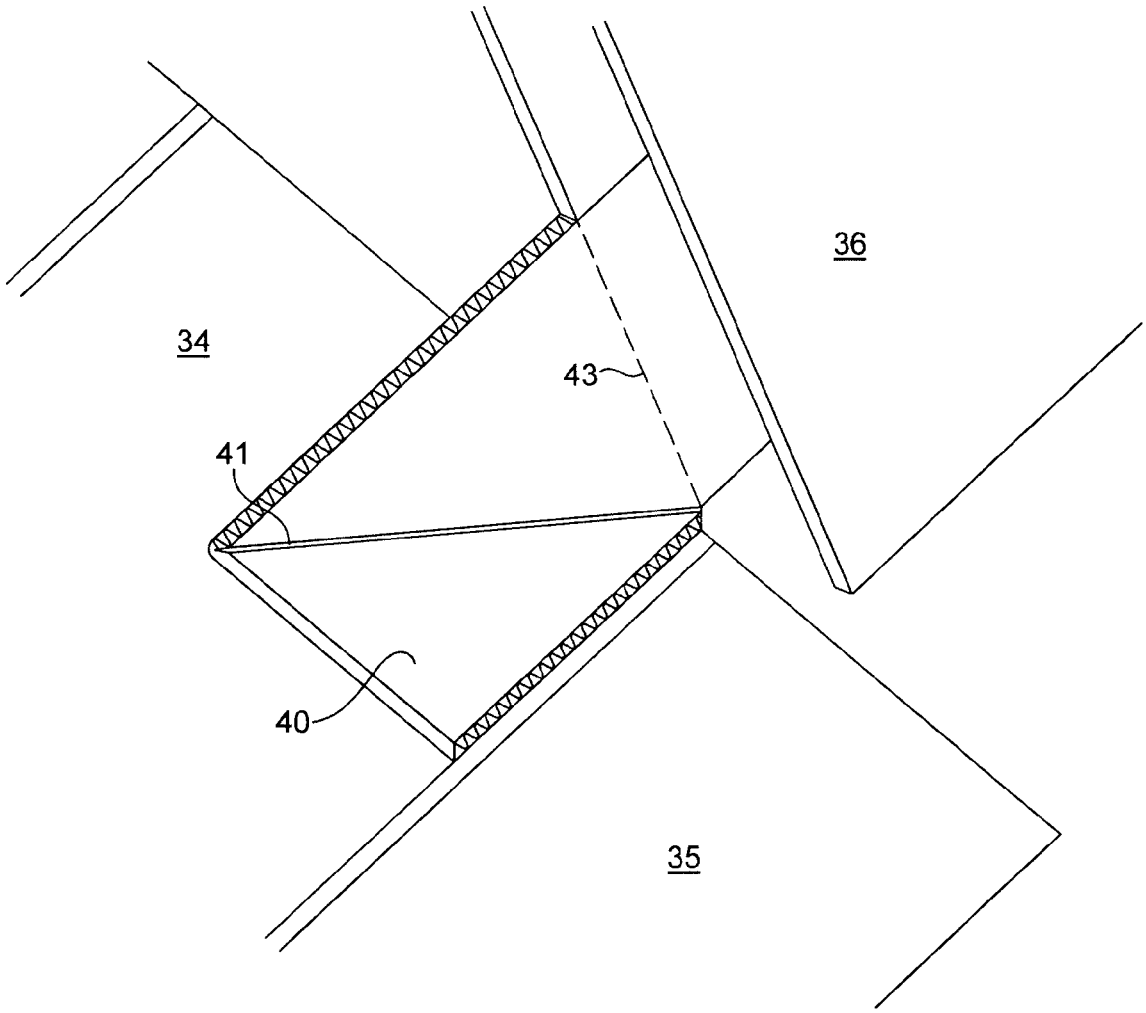
Figure 9:
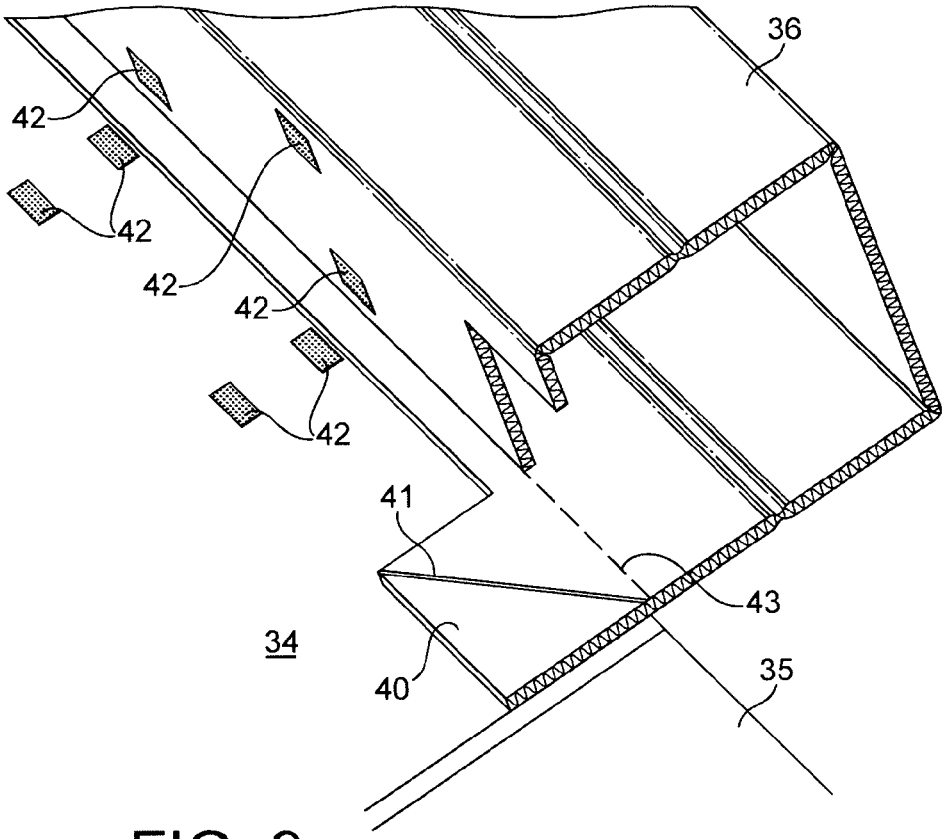

As can be seen in FIG. 7, if the box structure is tipped over clockwise as shown in FIG. 6, the internal cardboard structure may be unfolded to lay along the floor as shown. Sections 31 to 35 are then essentially coplanar and lying on the floor and on top of section 34 are mounted a pair of flat folded card members 36 and 37. As can be seen, these fold outwards to an erect substantially square cross-sectional shape, easiest seen in FIG. 9, and they are held on to section 34 by means of a triangular section 40. Triangular section 40 is connected via a fold line 41 to a second triangular section which is in turn connected via a fold line 43 to the main body of section 36. This enables the folded section 36 as shown in FIG. 7 to be swung up and then swivelled so that it lies in the position shown in FIG. 9. From the position shown in FIG. 9, the expanded square section part 36 can be rolled anti-clockwise to bring burr fastener pads 42 into contact with one another thus swivelling section 36 to lie against sections 33, 32 and 31. Prior to erecting the two sections 36 and 37 in this way, it is convenient to shut lid 20.

By then rotating the panels 31, 32 and 33 to lie in a vertical plane, the lid 20 then comes to rest on the tops of the expanded square sections 36, 37. Thus, as can be seen in FIG. 10, the erect structure resembles an archway having a floor section 34, 35, pillars 36, 37 and a lintel 21.

The invention claimed is:

1. A foldable archway structure comprising a unitary sheet material which is erectable from a flat condition to form an archway closed on one side by a wall section, wherein the archway has (1) vertical members which are each formed of a first set of panels of the sheet material hinged to the wall section and folded to form a prism having a vertical axis and (2) a horizontal lintel member formed by a second set of panels hinged to the wall section and foldable to form a second prism having a horizontal axis, wherein each of the first set of panels of said vertical members are foldable into a reduced size arrangement, and each such reduced size arrangement is foldable into a box formed by the second set of panels.

2. The archway structure according to claim 1, wherein the lintel member extends to either side of the vertical members when the archway is erected.

3. The archway structure according to claim 1 further comprising external decoration such that the archway structure simulates a fireplace when the structure is erected.

4. The archway structure according to claim 2 further comprising external decoration such that the archway structure simulates a fireplace when the structure is erected.

5. The archway structure according to claim 1 further comprising external decoration such that the archway structure simulates a gate or porch when the structure is erected.

6. The archway structure according to claim 2 further comprising external decoration such that the archway structure simulates a gate or porch when the structure is erected.

* * * * *